US007331067B2

(12) United States Patent
Pantos et al.

(10) Patent No.: US 7,331,067 B2
(45) **Date of Patent: *Feb. 19, 2008**

(54) TOILET SEAT LIFTING AND LOWERING DEVICE

(75) Inventors: William P. Pantos, Cardiff, CA (US); Curtis Sword, Cardiff, CA (US)

(73) Assignee: NoTouch Systems, Inc., Escondido, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/261,118

(22) Filed: Oct. 28, 2005

(65) Prior Publication Data

US 2006/0090252 A1 May 4, 2006

Related U.S. Application Data

(63) Continuation-in-part of application No. 11/187,252, filed on Jul. 25, 2005, now Pat. No. 7,168,106, which is a continuation-in-part of application No. 10/979,039, filed on Nov. 2, 2004, now Pat. No. 6,934,974.

(51) Int. Cl.
*A47K 13/10* (2006.01)

(52) U.S. Cl. ..... 4/246.1; 4/241; 4/428

(58) Field of Classification Search ..... 4/241, 4/246.1, 246.3, 246.4, 246.5, 248
See application file for complete search history.

(56) References Cited

U.S. PATENT DOCUMENTS 2,705,330 A * 4/1955 Knudsen ..... 4/246.1
3,516,095 A * 6/1970 Clifton et al. ..... 4/246.5
5,280,654 A * 1/1994 Wolfer ..... 4/246.1
5,444,877 A * 8/1995 Kumarasurier ..... 4/246.1
5,875,498 A * 3/1999 Joseph ..... 4/246.5
6,263,517 B1 * 7/2001 Brooks ..... 4/246.1
6,807,687 B2 * 10/2004 Marras ..... 4/246.1
6,934,974 B1 * 8/2005 Pantos et al. ..... 4/246.1

FOREIGN PATENT DOCUMENTS

WO WO 8804534 A1 * 6/1988

* cited by examiner

*Primary Examiner*—Tuan Nguyen
(74) *Attorney, Agent, or Firm*—Douglas C. Murdock APC

(57) ABSTRACT

A toilet seat lifting and lowering device for pivoting the seat to its raised position and for pivoting it back to its horizontal position without having to touch the seat. A first lever arm is rigidly attached at one end to a first part of a torque transfer mechanism and at its other end to a foot pedal and a second lever arm is rigidly attached at one end to a second part of the torque transfer mechanism and at its other end to the toilet seat. With the toilet seat in its horizontal position, a downward force on the pedal produces a rotation of the first part of the torque transfer mechanism which produces an opposite rotation of the second part of the torque transfer mechanism causing the toilet seat to pivot to its raised position. Lifting the pedal, preferably by providing an upward force under the pedal, lowers the seat to the horizontal position. In a preferred embodiment, a counterweight positionable on the first lever arm is provided to provide a constant torque to partially oppose the torque produced by the weight of the toilet seat about its pivot axis. In a preferred embodiment, the first and second parts of the torque transfer mechanism are both cams.

8 Claims, 11 Drawing Sheets

TOILET SEAT LIFTING AND LOWERING DEVICE

This application is a continuation-in-part of U.S. patent application Ser. No. 11/187,252 filed Jul. 25, 2005 now U.S. Pat. No. 7,168,106, which is a continuation-in-part of Ser. No. 10/979,039 filed Nov. 2, 2004 (which issued as U.S. Pat. No. 6,934,974 on Aug. 30, 2005). The present invention relates to toilets, and in particular, to toilet seat lifting and lowering devices.

BACKGROUND OF THE INVENTION

FIG. 14 shows prior art toilet 200. Toilet seat 202 is pivotally connected to toilet 200. To use a toilet a female will usually sit on seat 202 to urinate and/or defecate. In contrast, a male will usually lift seat 202 before urinating and sit on it only to defecate. Then, if the seat is raised, a female will need to lower it to either urinate or defecate and a male will need to lower it to defecate.

Because of its proximity to human waste, the act of lifting the toilet seat can be potentially harmful. Bacteria and waste on and underneath the seat can get onto the hands of the individual using the toilet. To remedy this problem, there are some devices in the prior art designed to enable a user to lift the toilet seat without using his hands. However, these devices are complicated to make and expensive to produce and purchase. Also, they are not commercially viable due to their poor design, impracticality and lack of adhesion to plumbing codes.

What is needed is a better toilet seat lifting and lowering device.

SUMMARY OF THE INVENTION

The present invention provides a toilet seat lifting and lowering device for pivoting the seat to its raised position and for pivoting it back to its horizontal position without having to touch the seat. A first lever arm is rigidly attached at one end to a first part of a torque transfer mechanism and at its other end to a foot pedal and a second lever arm is rigidly attached at one end to a second part of the torque transfer mechanism and at its other end to the toilet seat. With the toilet seat in its horizontal position, a downward force on the pedal produces a rotation of the first part of the torque transfer mechanism which produces an opposite rotation of the second part of the torque transfer mechanism causing the toilet seat to pivot to its raised position. Lifting the pedal, preferably by providing an upward force under the pedal, lowers the seat to the horizontal position. In a preferred embodiment, a counterweight positionable on the first lever arm is provided to provide a constant torque to partially oppose the torque produced by the weight of the toilet seat about its pivot axis. In a preferred embodiment, the first and second parts of the torque transfer mechanism are both cams.

DETAILED DESCRIPTION OF THE PREFERRED EMBODIMENTS

First Preferred Embodiment

Figure 1:
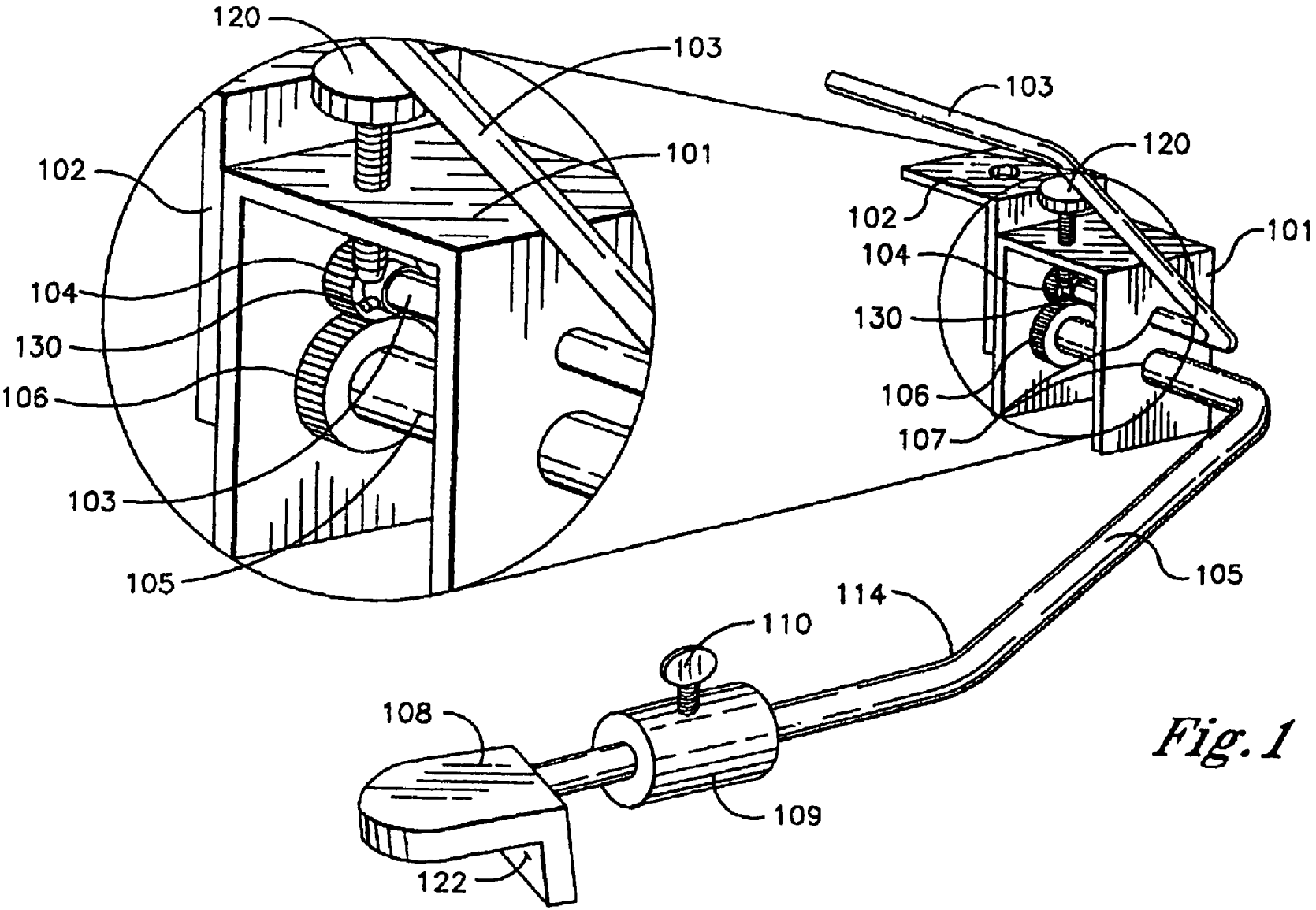
FIGS. 1-4 show a first preferred embodiment of the prior art.

A first preferred embodiment of the present invention is shown in FIG. 1. The first preferred embodiment includes housing 101, adapter bracket 102, second lever arm 103 connected to a small gear 104 at a first end. Second lever arm 103 is slidingly attached at its second end to seat 111 within attachment clip 112. Also the first preferred embodiment includes first lever arm 105 connected at one end to pedal 108 and at the other end to large gear 106. Gears 104 and 106 form a torque transfer mechanism whereby torque applied at foot pedal 108 is transferred to toilet seat 111 through second lever arm 103 extending into housing 101 through lever entry holes 107.

Figure 2:
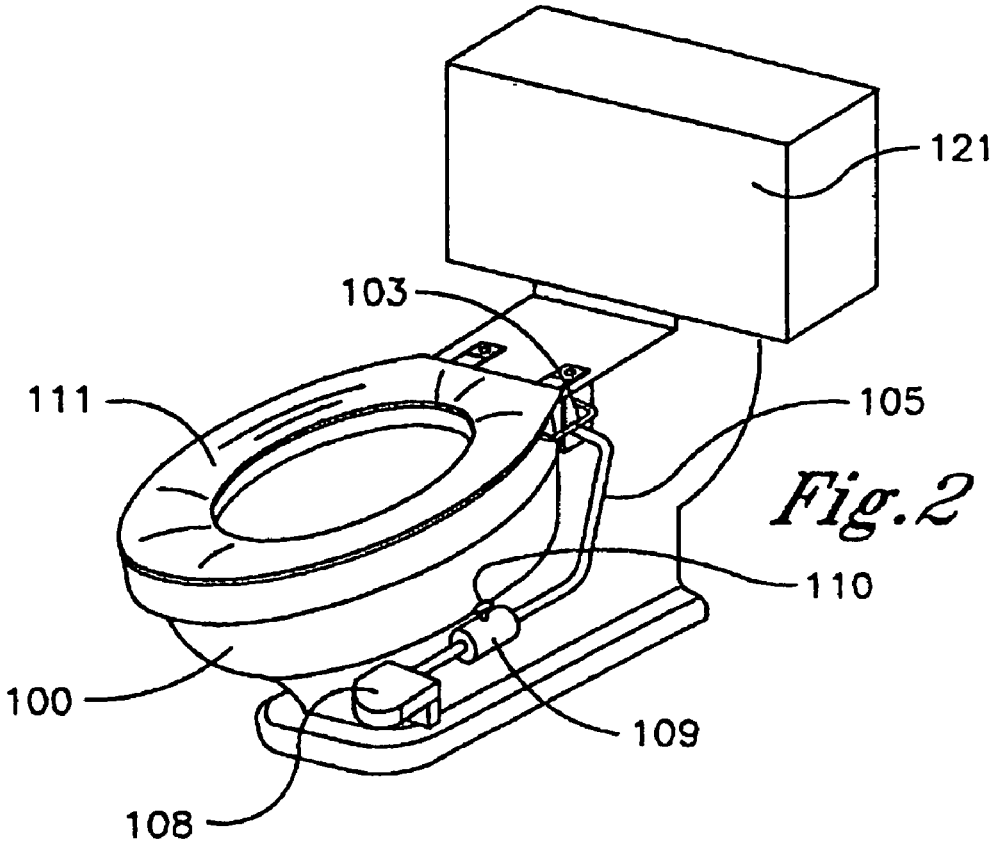
Figure 3:
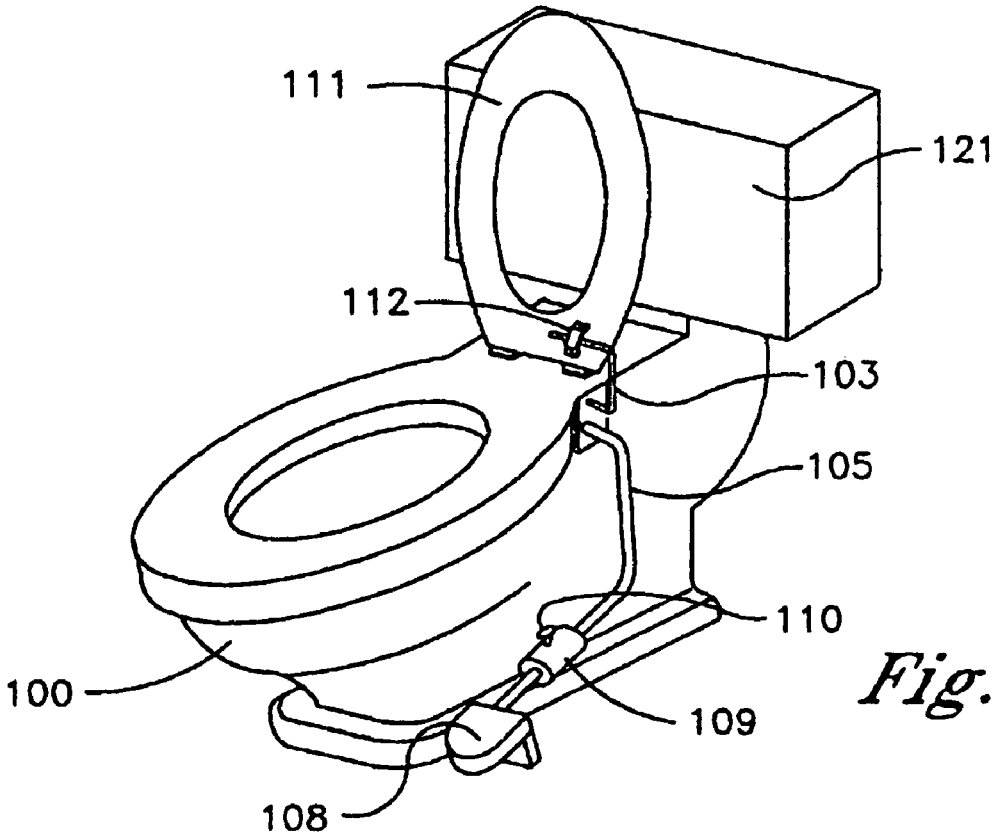

First lever arm 105 extends away from housing 101 alongside toilet 100 towards the floor, as in FIG. 2 and FIG. 3. First lever arm 105 preferably includes pedal 108 and adjustable counterweight 109 with screw 110. As seen in FIG. 3, second lever arm slides within attachment clip 112 attached to the underside of the toilet seat 111.

Figure 4:
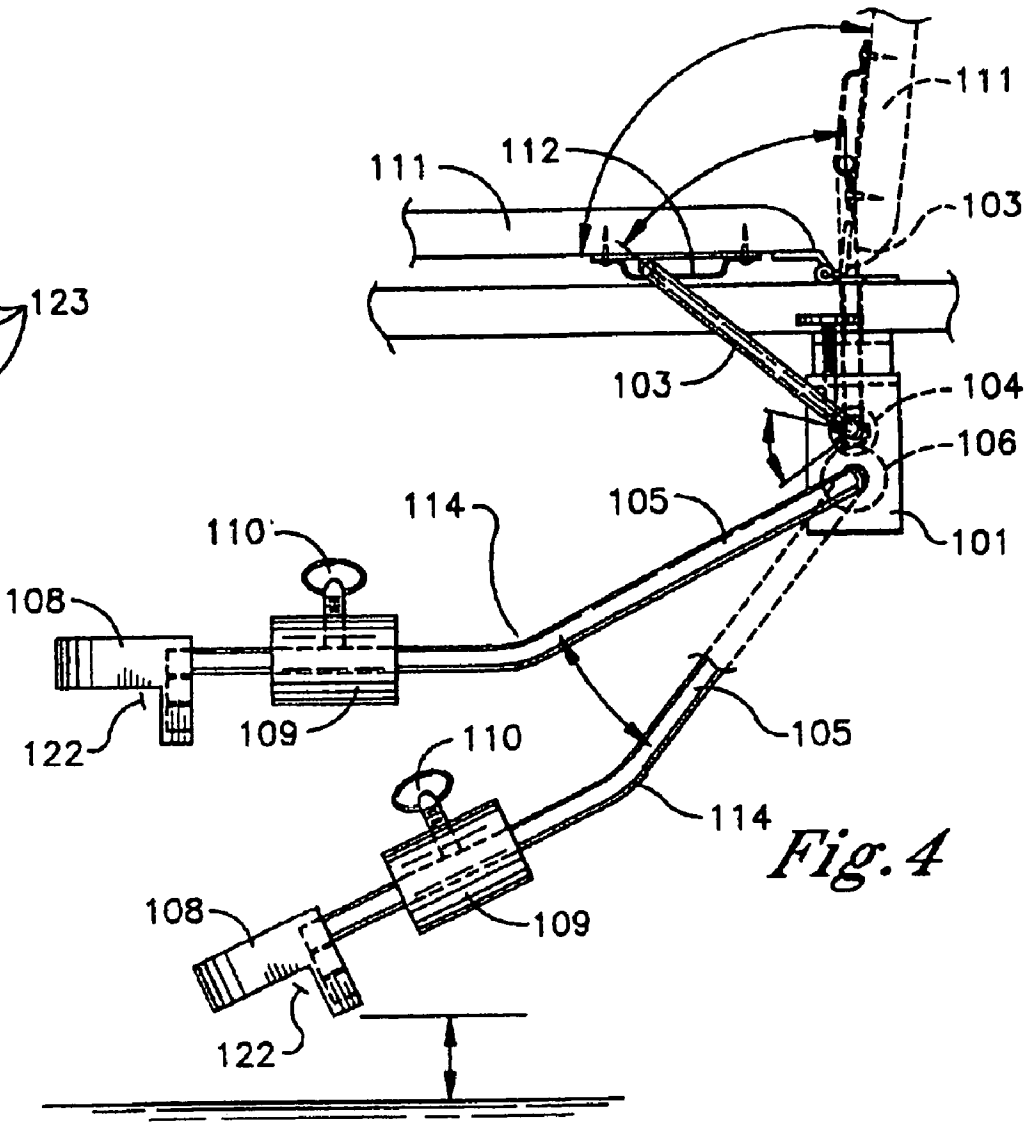

As seen in FIG. 4, seat 111 is raised by a user pressing his foot on pedal 108 and lowered by placing his foot under pedal 108 and lifting pedal 108 upwards. When a user presses down pedal 108 with his foot, first lever arm 105 rotates downward (counterclockwise as viewed in FIG. 4) causing large gear 106 to rotate counterclockwise which in turn causes small gear 104 and second lever arm 103 to rotate clockwise. The clockwise rotation of second lever arm 103 produces a clockwise rotation of seat 111. The upward force causes seat 111 to lift. Conversely, toilet seat 111 is lowered by the user placing his foot under pedal 108 and lifting upward on pedal 108.

When seat 111 is raised, second lever arm 103 slides from one end of attachment clip 112 to the other. As shown in FIG. 4, seat 111 is lifted with only a small angular rotation of second lever arm 103.

As shown in FIG. 1, the first preferred embodiment includes thumb screw 120. Thumb screw 120 passes from the outside into the interior of housing 101. As the user steps on pedal 108, gear 106 rotates counterclockwise and gear 104 rotates clockwise (see also FIG. 4). As gear 104 rotates clockwise stub 130 contacts screw 120. This causes the rotation of second lever arm 103 to stop and prevents seat 111 from hitting toilet tank 121 (FIGS. 2 and 3).

Counterweight

Counterweight 109 is preferably movable up and down the length of the first lever arm 105 between pedal 108 and the first lever arm angle 114. Once counterweight 109 has been appropriately positioned, its position is secured by tightening screw 110. A function of counterweight 109 is to provide a torque countering the torque provided by the weight of the toilet seat about the pivot position of the toilet seat. For example, as counterweight 109 is moved closer to pedal 108, second lever arm 103 exerts greater angular force on the underside of toilet seat 111. A preferred position of counterweight 109 is the one at which the torque produced by counterweight 109 and large lever arm 105 almost (but not quite) balances the torque produced by the weight of toilet seat 111 so that in the seat's lowered position only a small downward force on pedal 108 is required to raise the seat to its full upward position. Therefore, as toilet seat 111 is lowered the force exerted by second lever arm 103 and the extra weight provided by counterweight 109 help slow the descent of seat 111 and therefore helps prevent toilet seat 111 from being slammed onto the rim of the toilet.

Pedal

Figure 5:
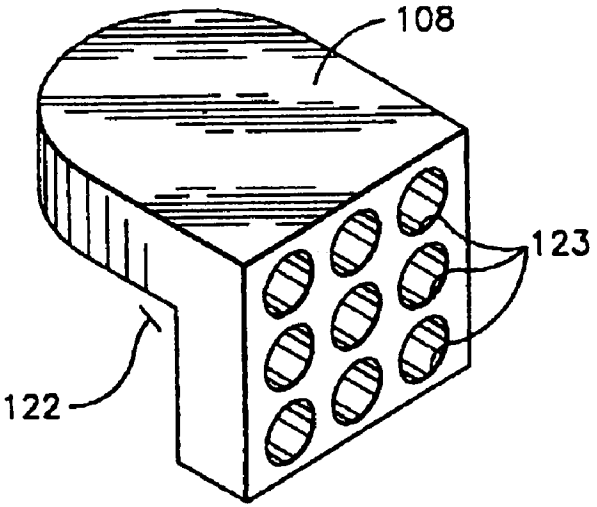
FIG. 5 shows a preferred pedal.

Pedal 108 is shaped to permit space 122 under the upper surface of the pedal to position the foot for lifting the pedal 108. The pedal preferably possesses a multiplicity of holes 123 (FIG. 5) that permit the insertion of first lever arm 105. A user can choose which of the holes to insert first lever arm 105. The distance above the floor pedal 108 rests when toilet seat 111 is raised is thereby adjusted.

Preferred Method for Installing First Preferred Embodiment

Figure 14:
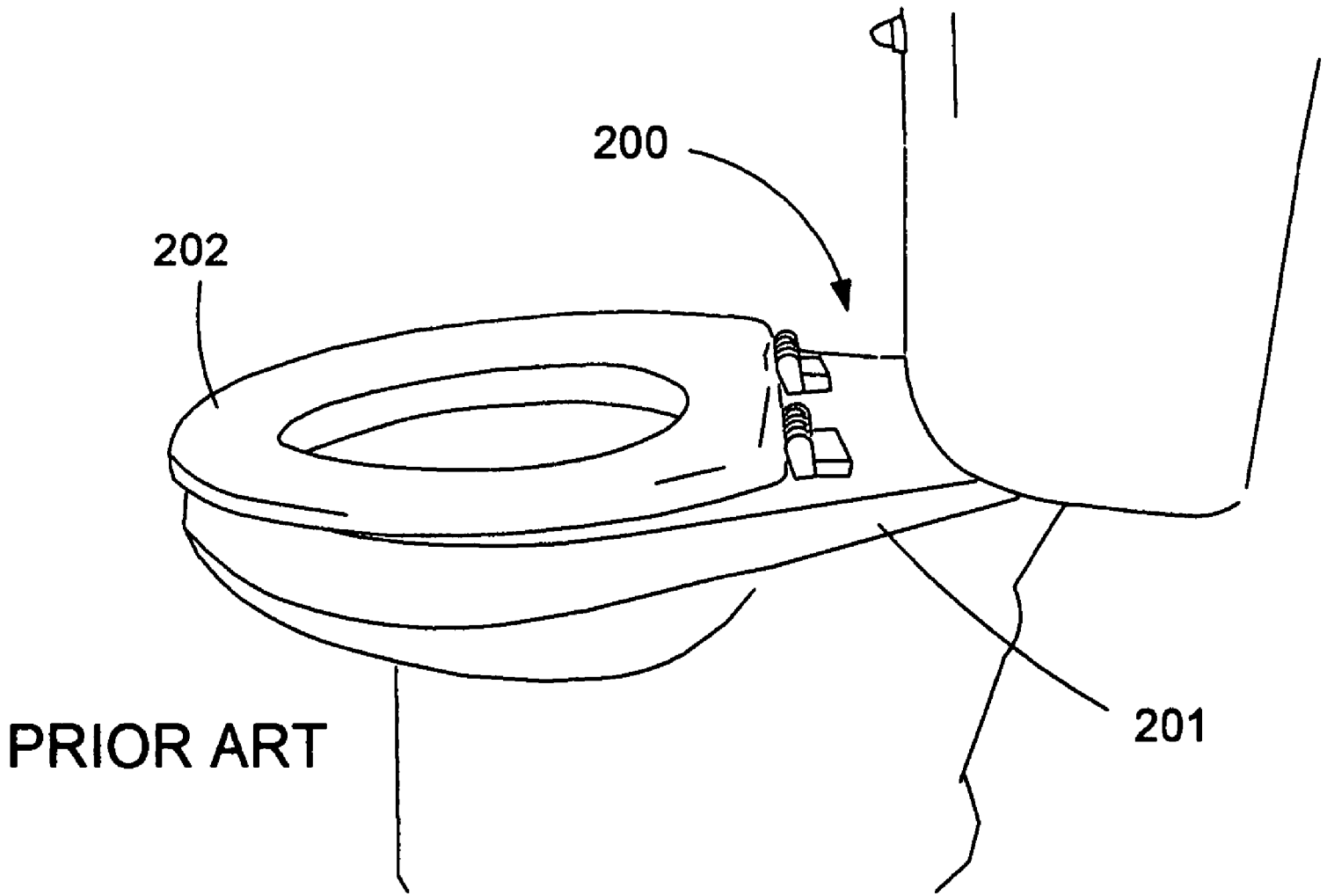
FIGS. 14-15B show a prior art toilet.
Figure 15A:
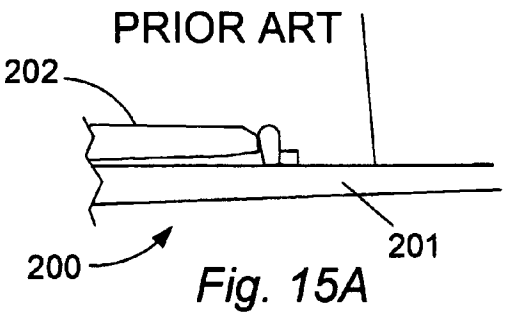
Figure 15B:
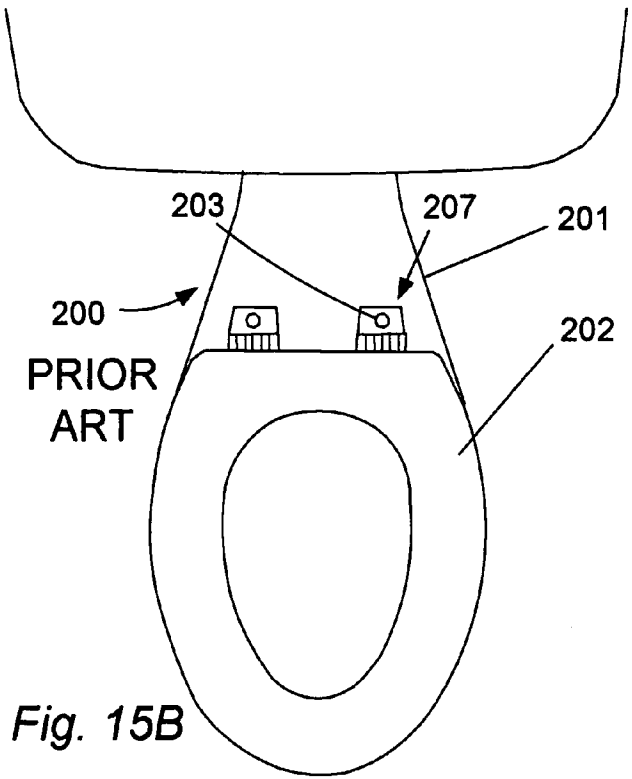

FIGS. 14, 15A and 15B show prior art toilet 200. Prior art toilet 200 includes lip 201, bolts 203, hinges 207 and seat 202.

Figure 16A:
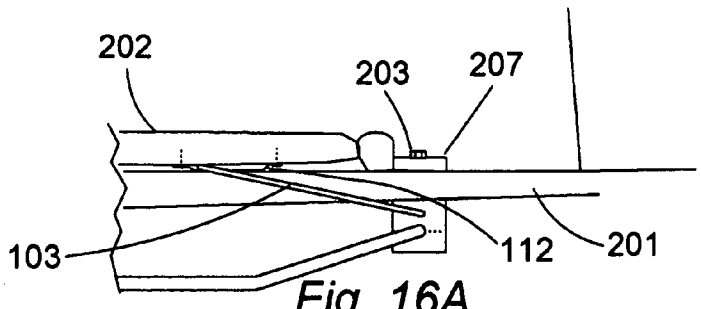
FIGS. 16A-16B show a preferred method for installing the first preferred embodiment.
Figure 16B:
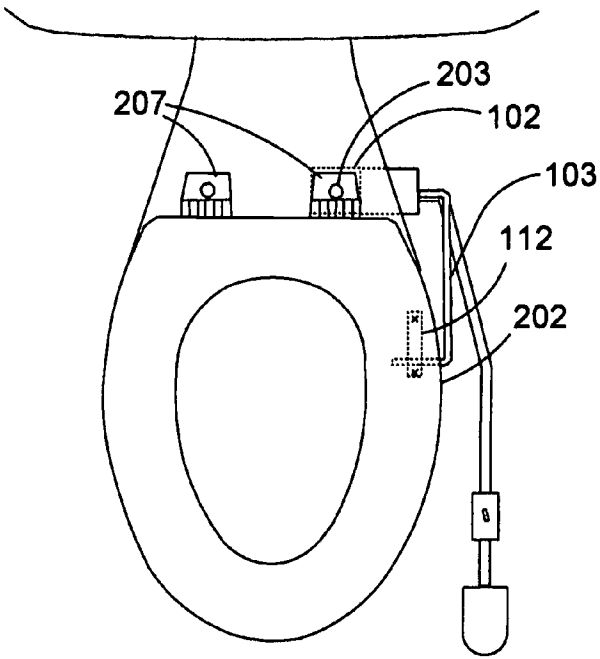

The method for installing the first preferred embodiment is extremely simple and can be accomplished very quickly and used on a variety of toilet types, shapes and sizes. For example, FIGS. 16A-16B illustrate a preferred method for installing the first preferred embodiment.

Preferably, attachment clip 112 is first screwed into seat 202. Then, second lever arm 103 is positioned between attachment clip 112 and seat 202. Then, pre-existing bolt 203 is used to bolt adapter bracket 102 underneath lip 201.

The first preferred embodiment is now ready for in accordance with procedures similar to that explained above.

Second Preferred Embodiment

Figure 6:
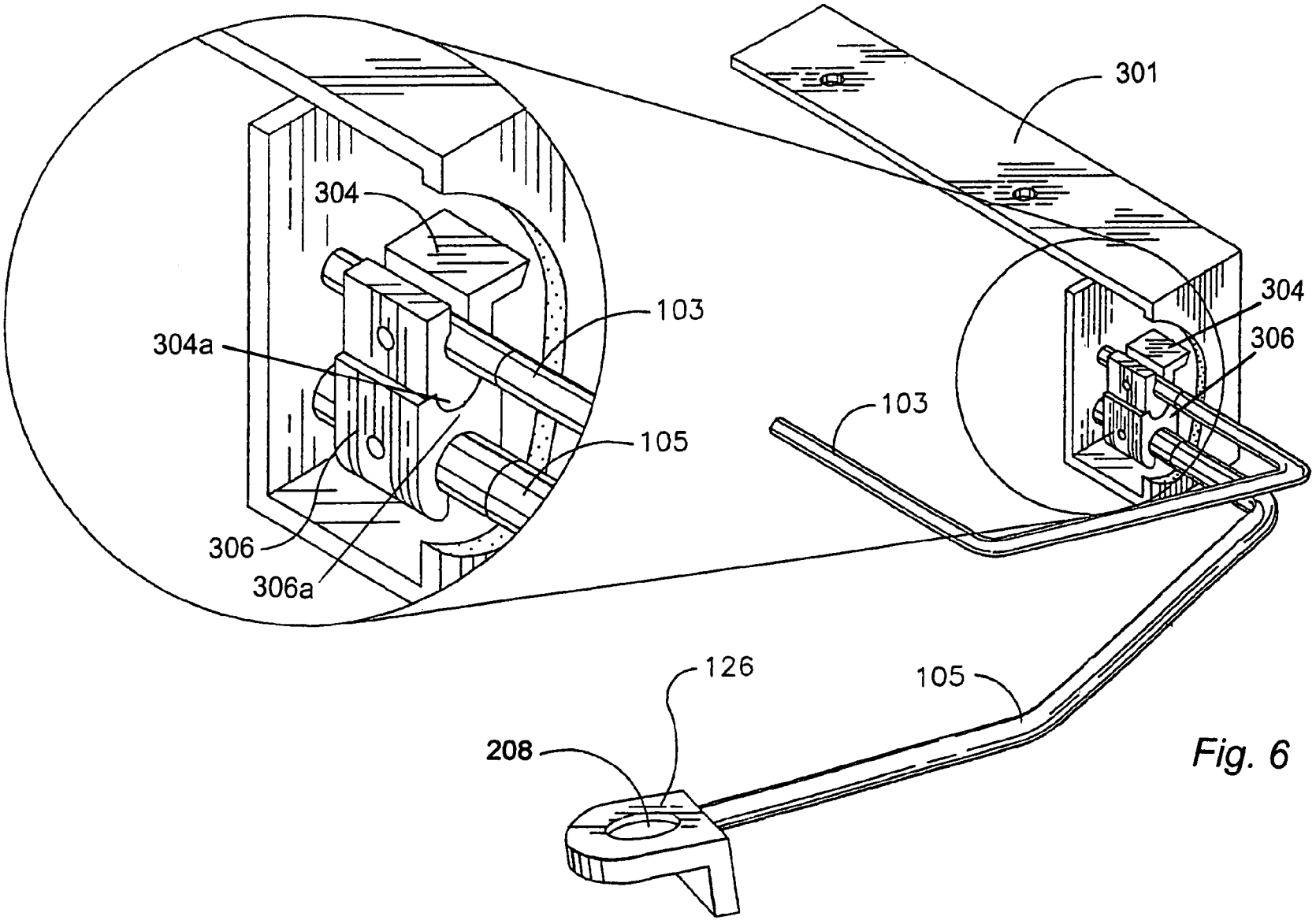
FIGS. 6-9 show a second preferred embodiment of the prior art.

The second preferred embodiment includes housing 301 (FIG. 6) and cams 304 and 306. It should be noted that cams 304 and 306 have been modified from gears 104 and 106 shown in the first preferred embodiment. (The reader should note that cams 304 and 306 may also correctly be referred to as single-toothed gears or cam gears. Although cams 304 and 306 are shaped differently than gears 104 and 106, cams 304 and 306 are similar to gears 104 and 106 in that they both have the similar function of transferring rotational motion from first lever arm 105 to second lever arm 103.)

Housing

Figure 7:
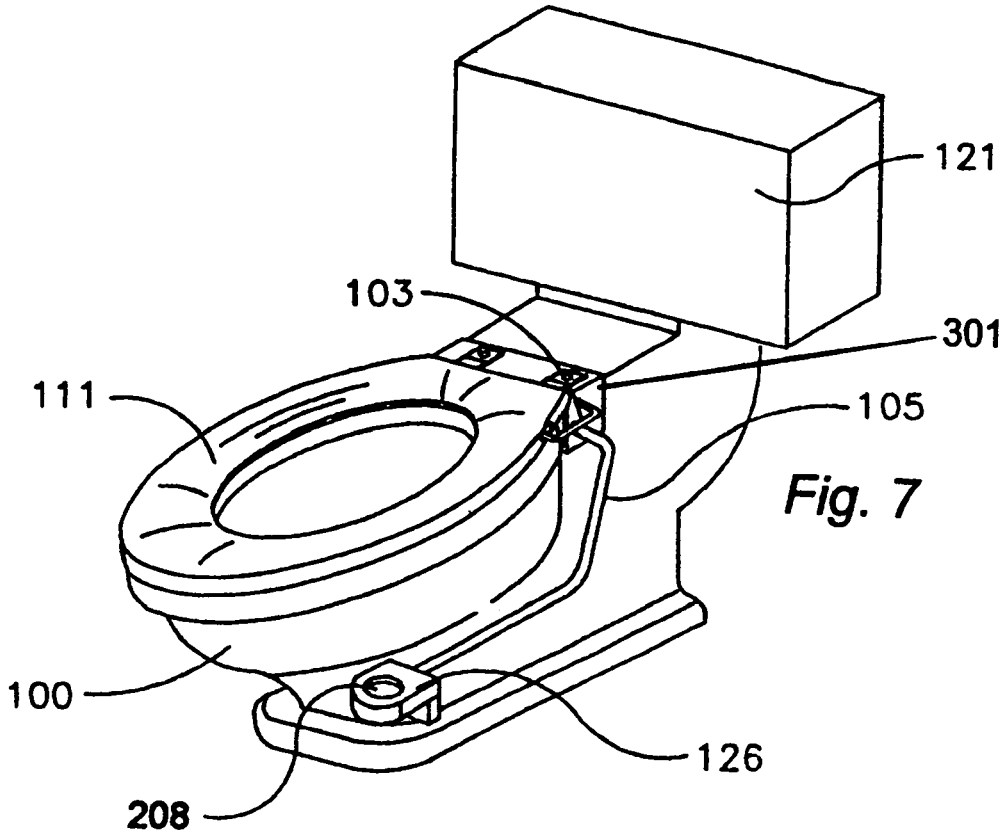

In addition to housing cams 304 and 306, housing 301 also is utilized to connect seat 111 to toilet 100 (FIG. 7). Therefore, by utilization of housing 301, it is not necessary to include a separate adapter bracket such as adapter bracket 102 shown in the first preferred embodiment. Preferably, rubber gasket 279 is placed between housing 301 and toilet 100 (FIG. 8).

Cams

The second preferred embodiment includes second lever arm 103 pin connected to upper cam 304 and first lever arm 105 pin connected to lower cam 306. As shown in FIGS. 6, 9 and 11-13, cam 304 is preferably in the general shape of a single-toothed gear having single tooth 304*a* and cam 306 has a single groove 306*a* to receive single tooth 304*a*. The cams of the second preferred embodiment replace gears 104 and 106 of the first preferred embodiment. Like gears 104 and 106, cams 304 and 306 mesh with each other and enable first lever arm 105 to transfer rotational motion to second lever arm 103. In contrast to gears 104 and 106, cam 304 has one large single tooth and cam 306 has one large single groove. Hence, cams 304 and 306 are less likely to break or wear down after extended usage. They are also less expensive to manufacture than gears. For example, it is estimated that from a manufacture/supplier cams 304 and 306 cost approximately $0.15 each. In comparison, gears 104 and 106 cost approximately $4.00 each.

Figure 8:
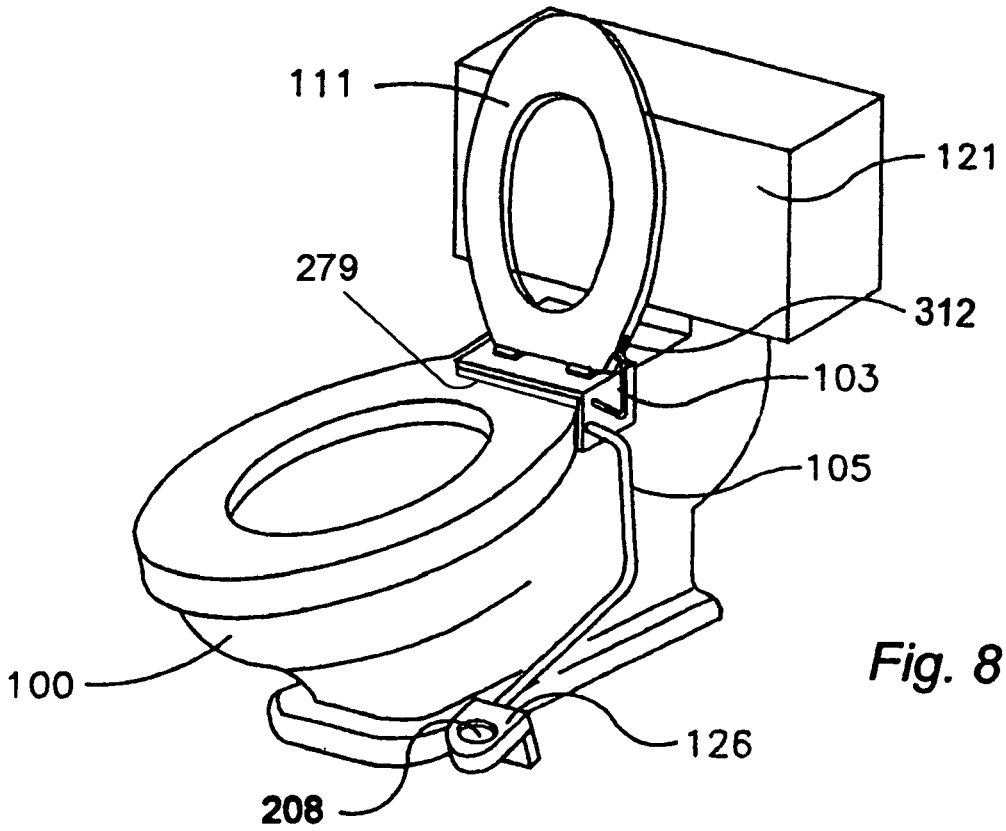

In the second preferred embodiment, first lever arm 105 extends away from housing 301 alongside toilet 100 towards the floor, as shown in FIGS. 7 and 8. Pedal 126 with clutch/crane receptor 208 is attached to the end of first lever arm 105. Second lever arm 103 is inserted into the side of toilet seat 111 by means of attachment slot 312. Attachment slot 312 replaces attachment clip 112 of the first preferred embodiment.

Figure 9:
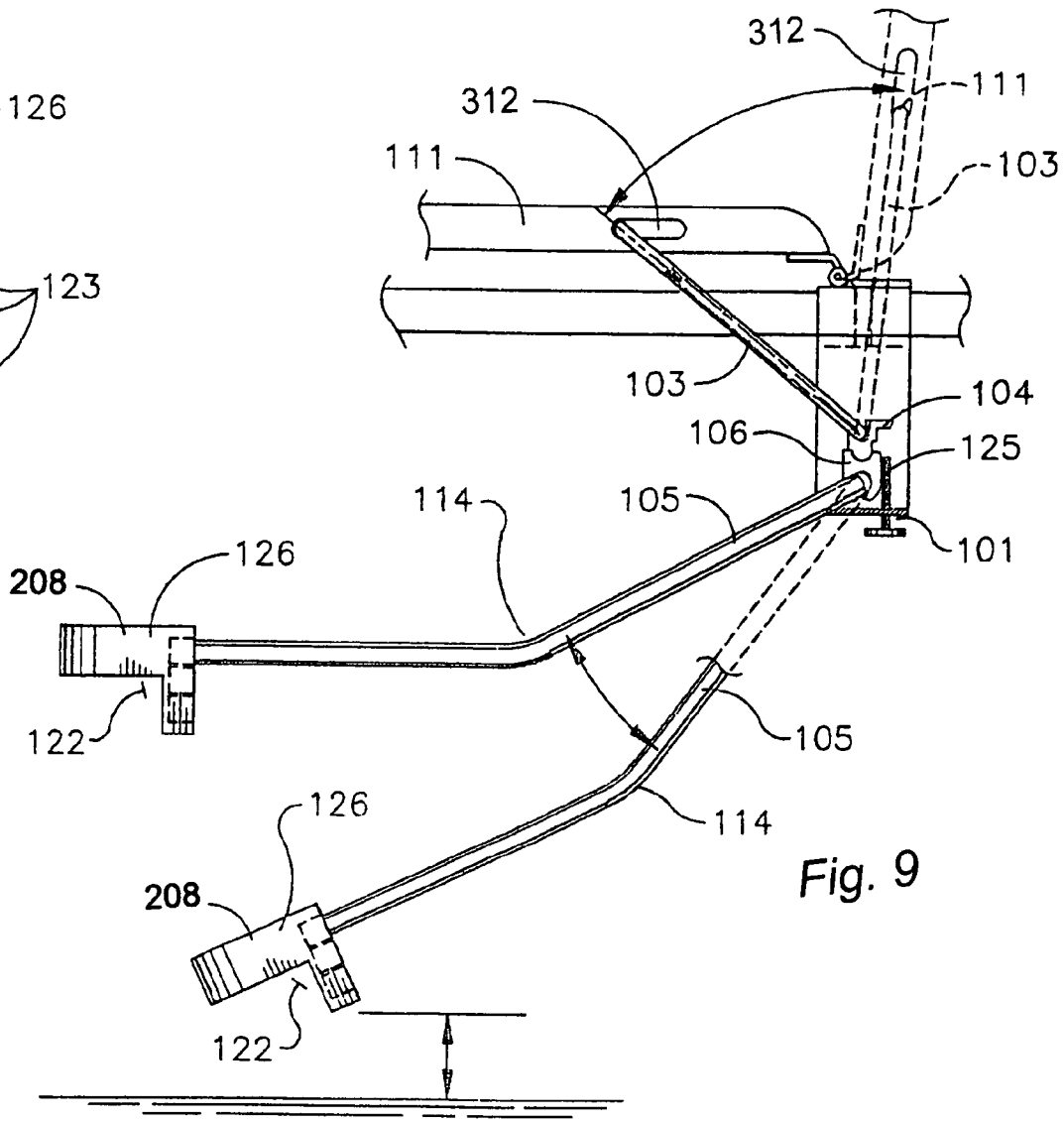

As shown in FIG. 9, seat 111 is raised by pressing pedal 126 with the foot. When a user presses pedal 126 with his foot, first lever arm 105 rotates counterclockwise causing second lever arm 103 to rotate clockwise. The clockwise rotation of second lever arm 103 causes second lever arm 103 to exert an upward force onto seat 111. The upward force causes seat 111 to lift. Conversely, toilet seat 111 is lowered by the user placing his foot in pedal recess 122 (FIG. 10) and lifting upward on pedal 126.

Figure 13:
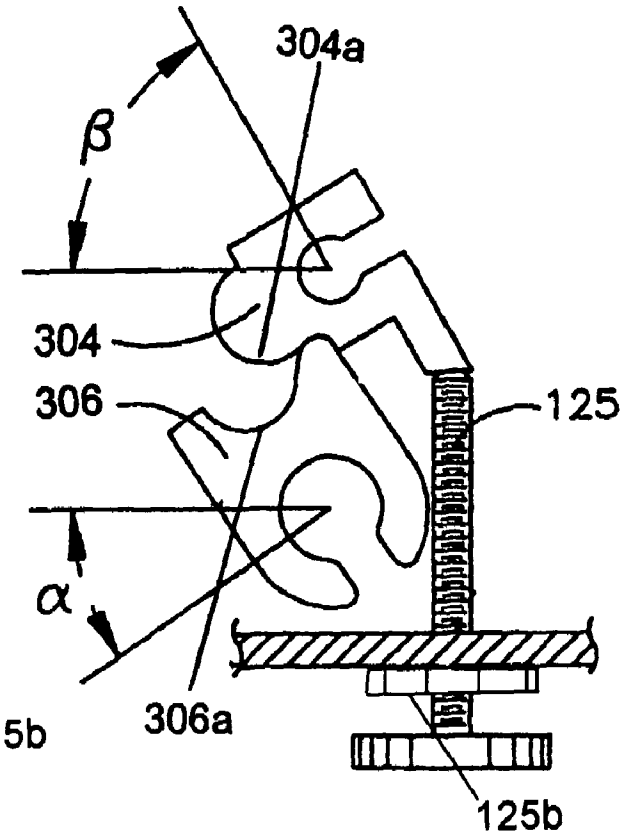
FIGS. 11-13 show a preferred gear and a gear follower.
Figure 12:
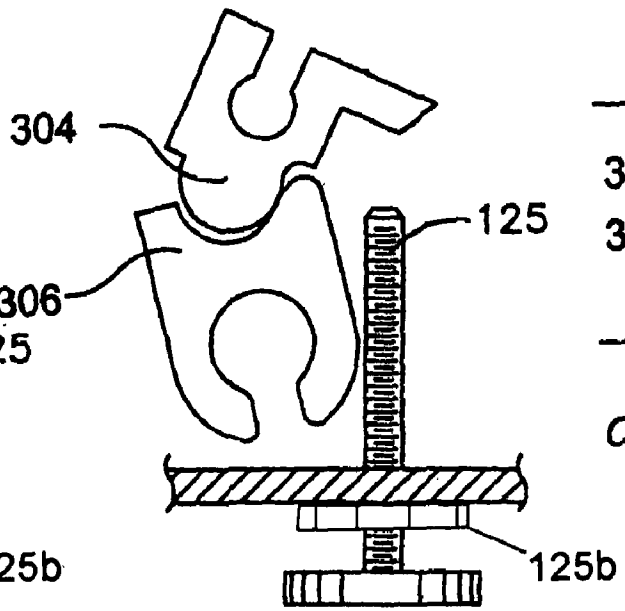
Figure 11:
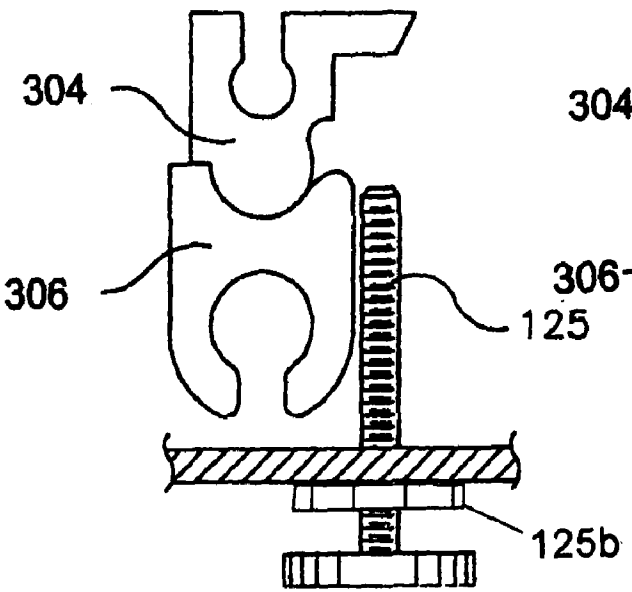

When seat 111 is lifted, second lever arm 103 slides from one end of attachment slot 312 to the other allowing seat 111 to be lifted through angle β with only a small angular rotation a of first lever arm 105. This angular rotation is shown in FIGS. 11-13.

As shown in FIGS. 9, and 11-13, thumb screw 125 passes from the outside into the interior of housing 101. Thumb screw 125 is used to control the stopping position of second lever arm 103 as seat 111 is raised. By controlling the stopping position, seat 111 is prevented from hitting toilet tank 121. Locking nut 125*b* is utilized to help ensure that the position of thumb screw 125 does not accidentally shift during usage.

Pedal

Pedal 126 preferably weights approximately 1.5 pounds. In addition to functioning as a place for the user to put his foot, the extra weight of pedal 126 also allows the pedal to function as a counterweight. As with counterweight 109 discussed in the first preferred embodiment, counterweighted pedal 126 helps slow the descent of seat 111 and therefore helps prevent toilet seat 111 from being slammed onto the rim of the toilet.

Figure 10:
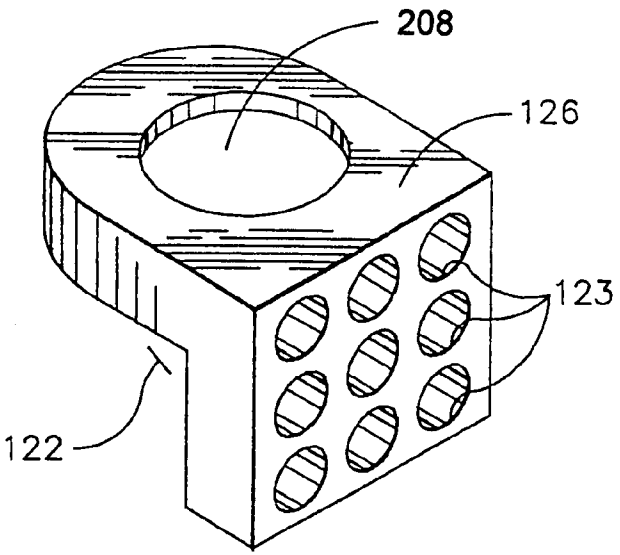
FIG. 10 shows another preferred pedal.

As shown in FIGS. 9 and 10, pedal 126 is shaped to include space 122 to position the foot for lifting the pedal. As with the first preferred embodiment, pedal 126 possesses a multiplicity of holes 123 that permit the insertion of first lever arm 105. The top of pedal 126 includes a crutch/cane receptacle 208 that will accommodate the tip of a crutch or cane, making it easier to depress the pedal for handicapped individuals.

Third Preferred Embodiment

Figure 18:
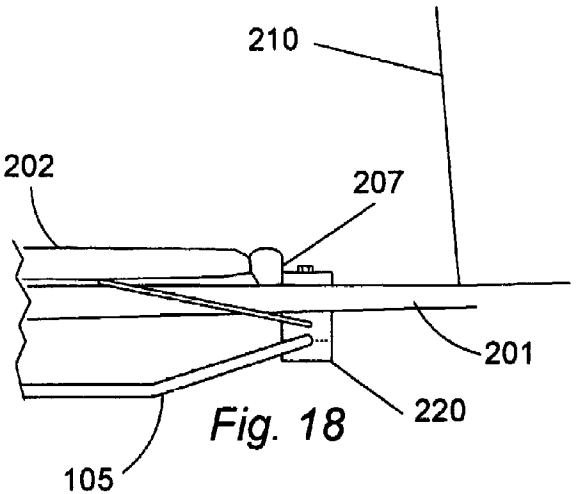
FIGS. 17-19 show a third preferred embodiment.
Figure 19:
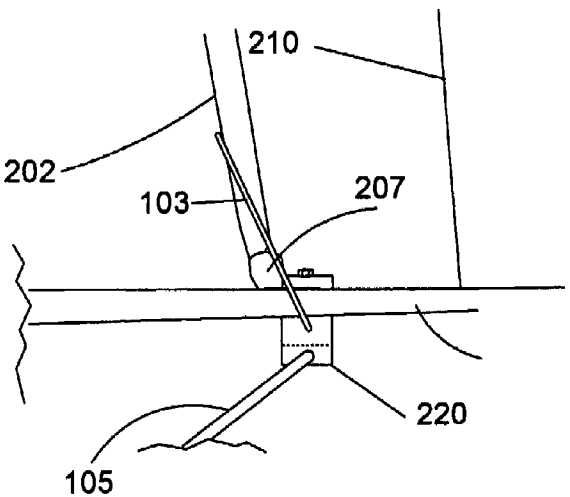
Figure 17:
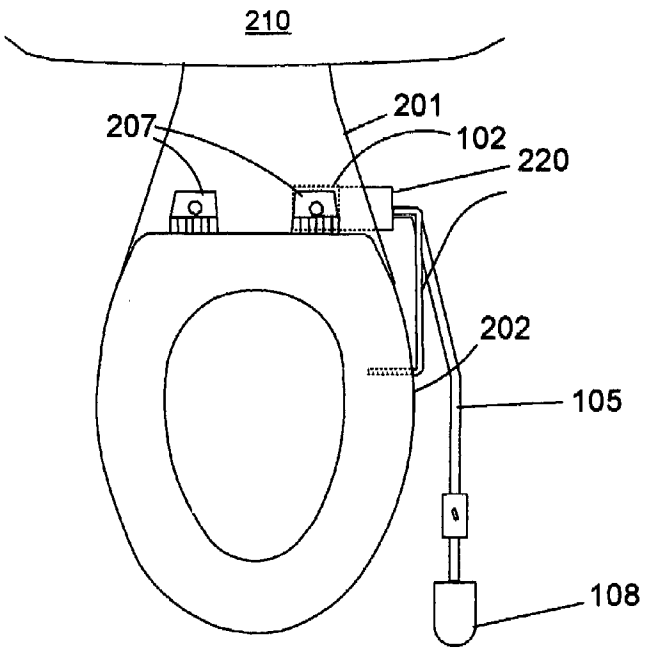

A third preferred embodiment is shown in FIGS. 17-19. As in the first preferred embodiment, seat 202 is connected to toilet 210 via hinges 207 and adapter bracket 102 is bolted to lip 201. However, in the third preferred embodiment, it is not necessary to utilize an attachment clip or an attachment slot.

In FIG. 19, the user has stepped on pedal 108 and second lever arm 103 has exerted an upward force on seat 202 in a fashion similar to that described above in reference to the earlier embodiments. Hinge 207 allows seat 202 to easily pivot about the hinge between the position shown in FIG. 18 and the position shown in FIG. 19. It should be noted that in FIG. 19 seat 202 is not completely vertical, but rather is leaning slightly to the left.

To lower seat 202, the user places his foot under pedal 108 and lifts upward in a fashion similar to that described above in reference to the earlier embodiments. The force of gravity acting on seat 202 causes the seat to lower as second lever arm 103 goes to the position shown in FIG. 18. Also, it should be noted that the third preferred embodiment also preferably includes a locknut similar to locknut 125*b* (shown in FIGS. 11-13) and also preferably includes a gasket similar to gasket 279 (shown in FIG. 8).

Preferred Pedal

Figure 21:
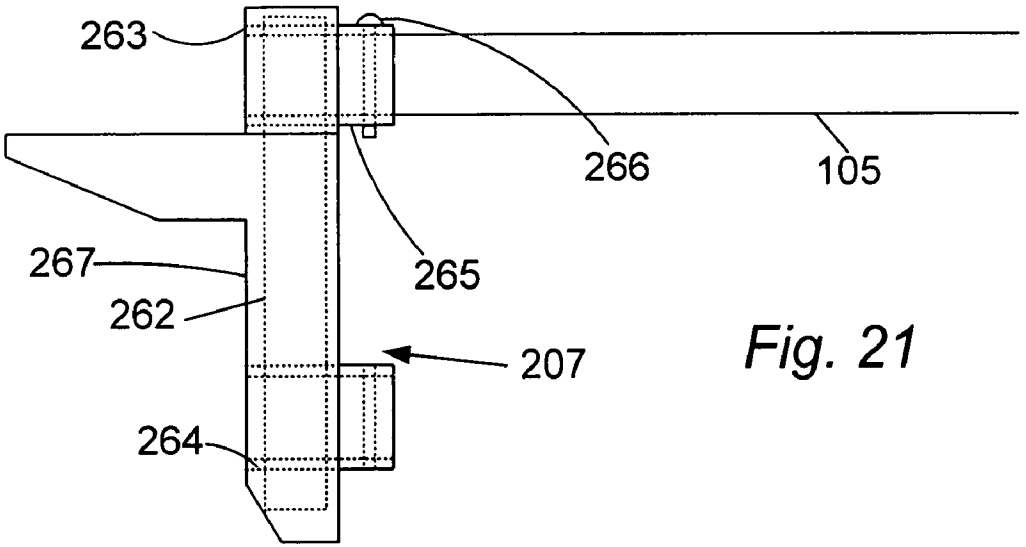
FIGS. 20-22 show a another preferred pedal.
Figure 20:
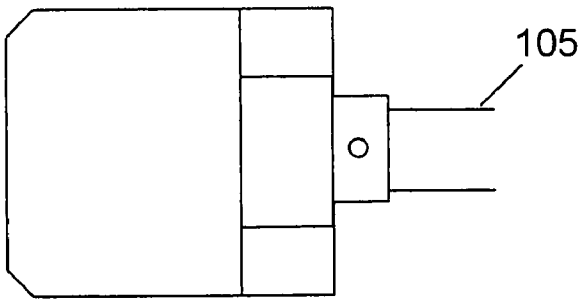
Figure 22:
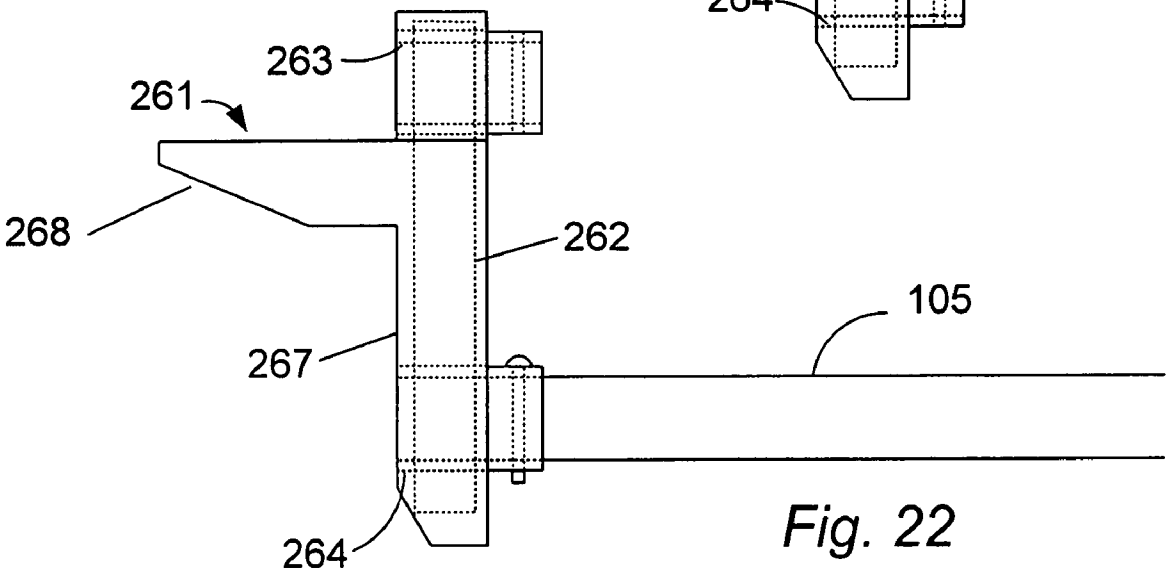

FIGS. 20-22 show preferred pedal 261. Preferred pedal 261 includes interior weight 262. In one preferred embodiment weight 262 weights approximately 2 pounds. Pedal 261 can be connected to first lever arm 105 via upper hole 263 or via lower hole 264. It is preferable to connect pedal 261 to first lever arm 105 via upper hole 263 (FIG. 21) for a taller toilet (i.e., a 17-inch toilet) and it is preferable to connect pedal 261 to first lever arm 105 via lower hole 264 (FIG. 22) for a shorter toilet (i.e., a 14-inch toilet). Pedal 261 also includes an extended vertical section 267 under horizontal portion 268. Vertical section 267 allows the user additional room to place his foot when lifting up on pedal 261 to lower the toilet seat.

Although the above-preferred embodiments have been described with specificity, persons skilled in this art will recognize that many changes to the specific embodiments disclosed above could be made without departing from the spirit of the invention. Therefore, the attached claims and their legal equivalents should determine the scope of the invention.

What is claimed is:

1. A toilet seat lifting and lowering apparatus for lifting and lowering a toilet seat of a toilet, comprising:

A) a foot pedal;

B) a torque transfer mechanism comprising a first part and a second part;

C) a first lever arm having first and second ends, said first end rigidly attached to said first part of said torque transfer mechanism and at said second end to said foot pedal;

D) a second lever arm having first and second ends, said first end of said second lever arm rigidly attached to said second part of said torque transfer mechanism and slidingly attached at said second end of said second lever arm to said toilet seat; and E) said first and second parts of said torque transfer mechanism are in contact with one another;

characterized in that when said toilet seat is in a horizontal position a downward force on said foot pedal produces a rotation of said first part of said torque transfer mechanism which by its engagement with said second part of said torque transfer mechanism produces an opposite rotation of said second part of said torque transfer mechanism causing said toilet seat to lift to a raised position, and wherein when said toilet seat is in its raised position an upward force applied under said foot pedal produces a rotation of said first part of said torque transfer mechanism which produces an opposite rotation of said second part of said torque transfer mechanism causing said second lever arm to move said toilet seat to its horizontal position, said first and second parts of said torque transfer mechanism comprising first and second cams.

2. The toilet seat lifting and lowering device as in claim 1, wherein either said first cam or said second cam comprises a single tooth and the other of said first cam or said second cam comprises a single groove to receive said single tooth.

3. The toilet seat lifting and lowering device as in claim 1, further comprising a counterweight attached to said first lever arm.

4. The toilet seat lifting and lowering device as in claim 3, wherein said counterweight is slidingly attached to said first lever arm.

5. The toilet seat lifting and lowering device as in claim 1, further comprising an attachment clip for receiving said second lever arm.

6. The toilet seat lifting and lowering device as in claim 1, further comprising an attachment slot for receiving said second lever arm.

7. The toilet seat lifting and lowering device as in claim 1, wherein said foot pedal comprises a crutch/cane receptacle.

8. A toilet seat lifting and lowering apparatus comprising:

A) a torque transfer mechanism comprising first and second cams, said second cam having a tongue which contacts a groove in said first cam;

B) first and second lever arms, said first arm connected to said first cam and to a foot pedal, said second arm connected to said second cam and in sliding contact with said toilet seat;

C) an attachment clip in contacted with said seat wherein said second lever arm is held between said seat and said attachment clip; and D) a counter weight slidably connected to said first lever arm, said apparatus characterized in that when a force is applied downward on said pedal, the first lever arm is caused to rotate translating such rotation to the first cam which displacement of said first cam causes said second cam to rotationally displace and translate such displacement to said second lever arm which in turn forces said seat to lift, and where an upward force applied to said pedal causes an opposite rotation of said first lever arm and thereby translates motion to said first cam which in turn acts upon said second cam to displace and thereby cause the second lever arm to rotate forcing said seat to a lower position.

* * * * *